US005284040A

United States Patent [19]

Beelen et al.

[11] Patent Number: 5,284,040

[45] Date of Patent: Feb. 8, 1994

[54] TUBE BENDING APPARATUS WITH STOP AND ABUTMENT MEANS TO SET BEND ANGLE

[75] Inventors: Valere H. J. Beelen, St. Trond, Belgium; David L. Machovina, Elyria, Ohio

[73] Assignee: Emerson Electric Co., St. Louis, Mo.

[21] Appl. No.: 987,798

[22] Filed: Dec. 9, 1992

[51] Int. Cl.[5] ..... B21D 7/024

[52] U.S. Cl. ..... 72/157; 72/149; 72/702; 72/217

[58] Field of Search ..... 72/149, 157, 158, 159, 72/217, 387, 459, 461, 441, 702

[56] References Cited

U.S. PATENT DOCUMENTS

| | | | |
|---|---|---|---|
| 1,575,014 | 3/1926 | Snell | 72/159 |
| 1,795,188 | 3/1931 | Wagenbach . | |
| 2,614,605 | 10/1952 | Senna | 72/158 |
| 3,236,082 | 2/1966 | Beck et al. | 72/149 |
| 3,285,048 | 11/1966 | Eskilson | 72/150 |
| 3,393,543 | 7/1968 | Van Gelder | 72/217 |
| 3,417,590 | 12/1924 | Ensley | 72/157 |
| 3,538,737 | 11/1970 | Del Monica | 72/459 |
| 3,584,492 | 6/1971 | Dodge | 72/217 |
| 3,742,749 | 7/1973 | Bondarenko et al. | 72/217 |
| 3,949,584 | 4/1976 | Pearson et al. | 72/149 |
| 4,052,875 | 10/1977 | Sakamoto | 72/217 |
| 4,223,543 | 9/1980 | Sakamoto | 72/217 |
| 4,981,030 | 1/1991 | Capcrusso et al. | 72/158 |
| 4,986,104 | 1/1991 | Cappcrusso et al. | 72/158 |
| 5,056,347 | 10/1991 | Wagner | 72/149 |

FOREIGN PATENT DOCUMENTS

| | | |
|---|---|---|
| 350457 | 8/1989 | European Pat. Off. . |
| 2098110 | 3/1982 | United Kingdom . |

*Primary Examiner*—Lowell A. Larson
*Assistant Examiner*—Michael J. McKeon
*Attorney, Agent, or Firm*—Body, Vickers & Daniels

[57] ABSTRACT

Tube bending apparatus comprising a lower support carrying a mandrel having a bending groove providing a bend axis, and an upper support mounted on the lower support for rotation about the bend axis and carrying a forming member for urging a tube between the mandrel and forming member into the bending groove on rotation of the upper support relative to the lower support. The upper support is adapted to be rotated relative to the lower support through a drive shaft arrangement extending downwardly from the lower support and coupled with a drive unit having an output coupling coaxial with the drive shaft and transverse to the axis of the drive motor of the drive unit. A stand supports the bending apparatus and drive unit relative to an underlying support surface during operation of the bending apparatus. The lower support is provided with angularly spaced apart abutment surfaces corresponding to different bend angles for a tube to be bent, and the upper support member is provided with a stop member which is selectively adjustable to engage any one of the abutment surfaces to provide the corresponding bend angle as well as a selectable degree of overbend of the tube relative to the bend angle.

58 Claims, 9 Drawing Sheets

10
12
18
22
24
25
26
28
32
36
38
40
42
44
45
46
48
50
52
56
58
60
62
64
66
68
70
72
74
78
90
104
104a
106
106a
108
108a
110
110a
116
124
148
150
152
162
180
A
B
C
F
T
2
3
4
7
+0°
+1°
+2°
+4°

TUBE BENDING APPARATUS WITH STOP AND ABUTMENT MEANS TO SET BEND ANGLE

BACKGROUND OF THE INVENTION

The present invention relates to the art of tube bending apparatus and, more particularly, to improvements in connection with bending a tube to a desired bend angle.

While the present invention finds particular utility in connection with portable, motor driven tube benders and, accordingly, will be described in detail hereinafter in conjunction therewith, it will be appreciated that the invention is applicable to bending other workpieces such as rods for example and is likewise applicable to bending apparatus which is either manually operated or motor driven and not necessarily portable in character.

Tube bending apparatus of the character to which the present invention is directed is well known and, basically, is comprised of mandrel and shoe or forming member components supported for relative angular displacement about a bending axis. The mandrel has a bending groove extending about the bending axis, and a tube positioned between the mandrel and forming member is adapted to be bent to a desired bend angle during relative angular displacement of the mandrel and forming member about the bending axis. Relative angular displacement between the mandrel and forming member can be achieved in a number of different ways. In a hand held bender, for example, the mandrel is mounted on one handle and the forming member is pivotally supported relative to the mandrel and associated with a second handle by which the forming member is displaced relative to the mandrel. In other hand operated and in some motor driven benders, the mandrel is mounted on a support and the forming member is mounted on the support for angular displacement relative to the mandrel and is so displaced by a manually actuated handle or through a motorized drive arrangement. In yet other motor operated benders, the forming member is supported against displacement and the mandrel is angularly displaced relative thereto such as by a drive motor.

Tube benders of the foregoing character are generally adapted to be operable to selectively bend a tube to a bend angle of up to 180°. Most frequently, the bend angle is 45°, 90° or 180°. In any event, it is extremely difficult to obtain accuracy with respect to bending a tube to a given bend angle. In this respect, tube benders heretofore available most often rely on indicia provided on the apparatus to visually indicate the angular degree of a bend to the operator. Regardless of whether or not the apparatus is manually operated or motor driven, considerable care must be taken to control the relative displacement between the mandrel and forming member in order to obtain an accurate bend as well as accuracy with respect to successive bends to the same or different bend angles. Further adding to the difficulty in connection with achieving accurate bends is the fact that the inherent resilience of the tube material can provide a spring-back effect, whereby overbending relative to a desired bend angle is necessary in connection with obtaining the desired bend angle. The degree of spring-back varies with the diameter of the tube, the wall thickness of the tube and/or the tube material. Therefore, even if a degree of overbending is taken into account in connection with providing the bend angle indicia on the apparatus, inaccuracy with respect to a given bend angle is likely to result from the foregoing variables, whereby more time and effort can be required on the part of the operator in an effort to obtain an accurate bend angle.

Manually adjustable stop arrangements have also been provided in connection with tube bending apparatus in an effort to obtain accurate bends. Such stop arrangements are shown, for example, in U.S. Pat. Nos. 3,236,082 to Beck et al and 3,417,590 to Ensley. However, such adjustable stops rely in part on the accuracy of positioning of one of the stop components by the operator and, while positively terminating a bending operation after a predetermined and fixed angular displacement between the mandrel and forming member, do not assure accuracy with respect to obtaining a given bend angle when the adjustable stop member is moved from one setting to another and then back to the one setting. Moreover, such adjustable stops do not compensate for the different degrees of overbending required as a result of the variances in tube diameter, wall thickness and tube material referred to above. Accordingly, the operator must either guess at the amount of overbend required and position the adjustable stop member accordingly, or attempt a number of overbends by trial and error in order to ultimately obtain the desired bend angle. In either event, an undesirable amount of time and effort on the part of the operator is required and, moreover, there is no assurance of being able to obtain the necessary degree of overbend from one bending operation to another if the required degree of overbend changes as a result of the foregoing variable factors.

SUMMARY OF THE INVENTION

In accordance with the present invention, pipe bending apparatus is provided which advantageously minimizes or overcomes the foregoing problems and disadvantages heretofore encountered in connection with obtaining an accurate bend angle from one bending operation to another. More particularly in accordance with the present invention, relatively displaceable mandrel and forming units are provided with an adjustable stop arrangement therebetween defined by positively positioned, relatively displaceable interengaging stop components which enable a tube to be bent to any one of a plurality of selectable bend angles. For each of the selectable bend angles, the same angular displacement between the mandrel and forming takes place during each bending operation, thus to eliminate potential operator error in connection with obtaining the desired bend angle.

In accordance with another aspect of the invention, the adjustable stop arrangement includes a further adjustment capability which, for each selectable bend angle, enables the operator to overbend the tube to any one of a plurality of selectable overbend angles relative to the selected bend angle. This adjustment enables compensating for different degrees of spring back resulting from differences in tube diameter, wall thickness and tube material. As with the selectable bend angles, each of the selectable overbend angles is achieved through interengagement between positively positioned stop components to provide the desired overbend angle in connection with each bending operation, thus to eliminate operator error in connection therewith.

Further in accordance with the invention, the stop arrangement is provided by fixed abutment surfaces angularly spaced apart from one another relative to the bend axis, each of which abutment surfaces corresponds to a given bend angle, and a stop member which is displaceable relative to the abutment surfaces and adjustable so as to selectively interengage any one of the abutment surfaces during relative angular displacement between the abutment surfaces and stop member. With respect to obtaining a selectable overbend angle in connection with each selected bend angle, the stop member is further adjustable in each of its bend angle positions to selectively vary the angular spacing between the stop member and the corresponding abutment surface so that the stop member and abutment surface interengage after the tube has been bent to an overbend angle corresponding to the overbend adjustment position of the stop member.

In accordance with a preferred embodiment of the invention, the abutment surfaces are on a fixed support which carries a mandrel member and which supports the forming unit for displacement relative to the mandrel about the bending axis. The abutment surfaces are axially stepped with respect to the bending axis, and the stop member is angularly displaceable with the forming unit relative to the abutment surfaces and is axially adjustable for a stop element thereon to be positioned in alignment with a selected one of the abutment surfaces.

Further in accordance with the preferred embodiment, the stop element on the stop member is rotatable about an axis parallel to the bending axis and has an eccentric peripheral surface with respect to the axis of rotation of the stop element. This provides for selectively positioning the peripheral surface of the stop element at different angular distances from a selected abutment surface so as to overbend a tube to a selectable overbend angle relative to the bend angle provided by the selected abutment surface.

Further in accordance with the preferred embodiment of the invention, the tube bending apparatus is driven by an operator controlled electric power drive unit through a drive train which includes a slip clutch which, upon engagement between the stop element and abutment surface, slips to preclude overloading the drive unit. The drive unit and bending apparatus are slidably separable relative to one another and to a ground, bench or stand supported base by which the drive unit and bending apparatus are supported during a tube bending operation. This support arrangement promotes portability and selectability with respect to the drive unit, facilitates assembly and disassembly of the components in connection with portability and further provides for compactness of the assembly and ease of operation of the bending apparatus. Still further in accordance with the preferred embodiment, the mandrel and forming member components are removable and any one of a plurality of different size mandrels and forming members are selectively usable with the apparatus. Thus, different mandrel and forming member combinations can be employed in connection with bending tubes of different diameter and/or to obtain different bend angle radii.

It is accordingly an outstanding object of the present invention to provide improved tube or rod bending apparatus of the character comprising relatively angularly displaceable mandrel and forming units for bending a workpiece therebetween to a desired bend angle in response to relative angular displacement therebetween.

Another object is the provision of bending apparatus of the foregoing character capable of more accurately bending a workpiece to a desired bend angle than heretofore possible.

A further object is the provision of bending apparatus of the foregoing character capable of overbending a workpiece to any one of a plurality of selectable overbend angles relative to a given bend angle for the workpiece.

Still another object is the provision of bending apparatus of the foregoing character providing adjustable, positively interengaging stop components for accurately bending a workpiece to any one of a selectable plurality of bend angles.

Yet another object is the provision of bending apparatus of the foregoing character with an adjustable stop arrangement providing for bending a workpiece to any one of a plurality of selectable bend angles and which stop arrangement is further adjustable to overbend the workpiece to any one of a selectable plurality of overbend angles relative to a selected bend angle.

Yet a further object is the provision of bending apparatus of the foregoing character which provides for selectively overbending a workpiece relative to a given bend angle to accurately compensate for variances in workpiece diameter, tubular workpiece wall thickness, and workpiece material.

A further object is the provision of bending apparatus of the foregoing character which is adapted to be driven by an electric power drive unit and to positively stop relative angular displacement between the component parts thereof upon attaining the predetermined bend angle, and to preclude the imposition of undesirable torque on the drive unit when such relative displacement is stopped.

Still another object is the provision of bending apparatus of the foregoing character which is portable, structurally compact, and easily assembled and disassembled relative to a drive unit and a base therefor.

Still a further object is the provision of bending apparatus of the foregoing character which provides selectivity with respect to mandrel and forming member components used thereon, thus to enable the apparatus to bend workpieces of different diameters and/or to different bend angle radii.

BRIEF DESCRIPTION OF THE DRAWING

The foregoing objects, and others, will in part be obvious and in part pointed out more fully hereinafter in conjunction with the written description of a preferred embodiment illustrated in the accompanying drawing in which.

DESCRIPTION OF PREFERRED EMBODIMENTS

Figure 1:
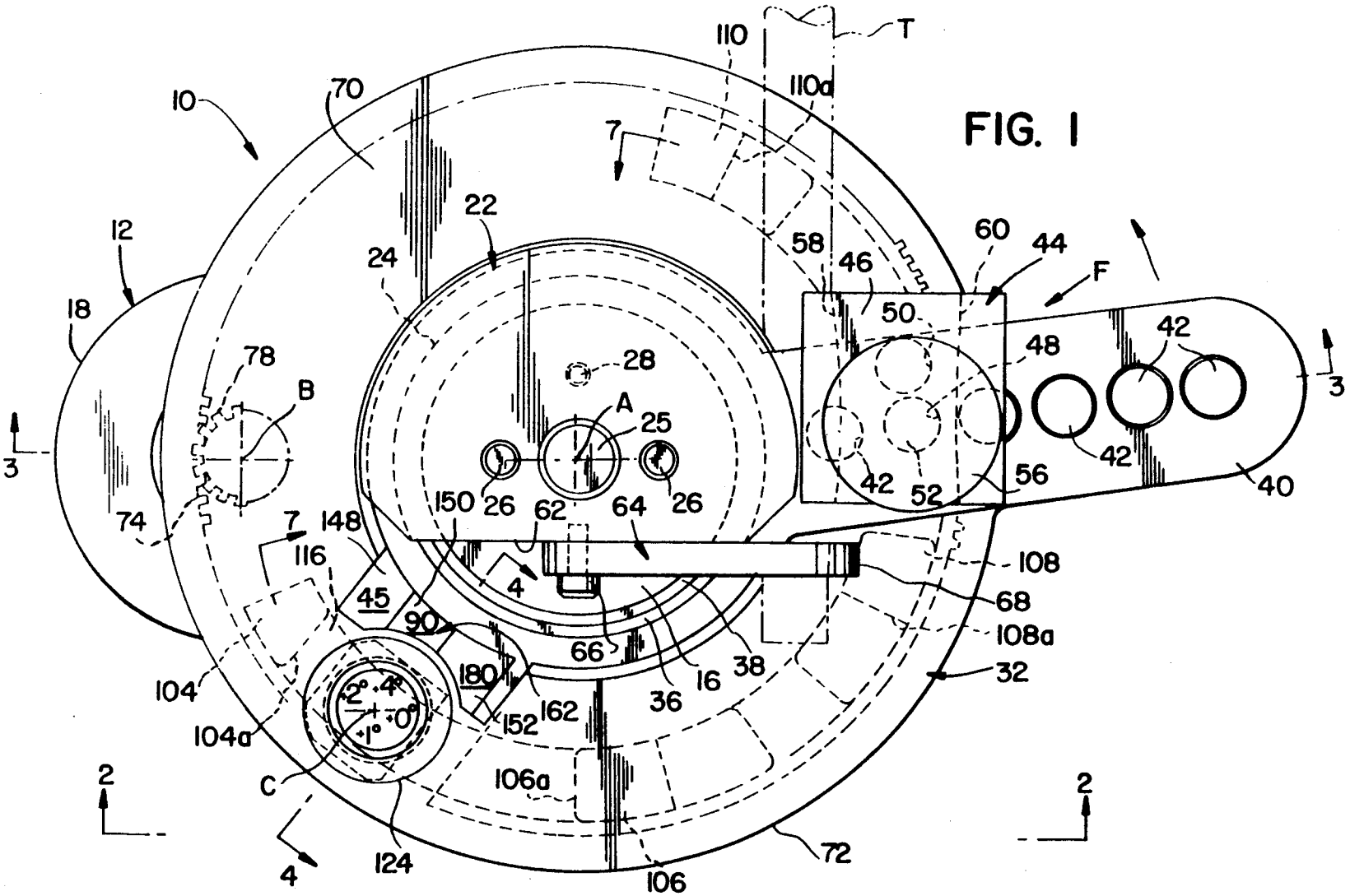
FIG. 1 is a plan view of tube bending apparatus in accordance with the invention.

Referring now in greater detail to the drawings wherein the showings are for the purpose of illustrating a preferred embodiment of the invention only and not for the purpose of limiting the invention, FIGS. 1–6 illustrate tube bending apparatus 10 in accordance with the present invention which is comprised of a mandrel unit M and a forming unit F relatively angularly displaceable about a bend axis A. Mandrel unit M includes a lower support 12 having a bottom wall portion 14 and a circular central portion 16 extending upwardly therefrom. For the purposes set forth hereinafter, support 12 further includes an annular drive shaft supporting sleeve 18 and a tubular post 20 depending from bottom wall 14. The mandrel unit further includes a mandrel member 22 having a bending groove 24 extending about the outer periphery thereof and coaxial with bend axis A. Mandrel 22 is removably supported on central portion 16 of support 12 by means of a central pin 25 coaxial with axis A and a pair of pins 26 radially spaced from axis A. A locating pin 28 assures appropriate orientation of the mandrel on support 12. Mandrel 22 is provided with openings, not designated numerically, which slidably receive pins 25, 26 and 28, and pins 26 preclude angular displacement of mandrel 22 about axis A.

Central portion 16 is provided with an annular shoulder 30 receiving and supporting a support member 32 of forming unit F for angular displacement relative to support 12 and thus mandrel 22 about bend axis A. Support 32 includes an opening 34 coaxial with axis A and receiving central portion 16 of support 12, and a sleeve bearing 35 is interposed between central portion 16 and opening 34. Support 32 is axially retained on central portion 16 by means of a washer 36 and retaining clip 38. Forming unit F further includes a forming member support arm 40 integral with support 32 and extending radially outwardly relative to axis A and provided with a plurality of radially spaced apart openings 42, and forming unit F further includes a forming member 44 mounted on arm 40 for angular displacement therewith about axis A and relative to mandrel 22. In the embodiment shown, forming member 44 includes a body portion 46 having openings 48 and 50 therethrough, and the forming member is removably mounted on arm 40 by means of a pin 52 extending through opening 48 and into one of the openings 42 in arm 40. Pin 52 is removably held in opening 42 by means of a rubber O-ring 54 on the inner end of the pin which frictionally interengages with opening 42. The outer end of pin 52 is provided with a knob 56 to facilitate insertion and removal of the pin. Forming member 44 includes recesses 58 and 60 on radially opposite sides of body 46, and in the mounted position of the forming member shown in FIGS. 1–3, recess 58 opens radially inwardly toward mandrel 22. Recess 58 is complementary with respect to mandrel recess 24 for bending a tube of corresponding outer diameter. Forming member 44 is also adapted to be mounted on arm 40 with recess 60 opening radially inwardly toward a different mandrel mounted on central portion 16 of support 12 and having a bending groove with which recess 60 is complementary, thus to enable the bending of a tube having a different outer diameter. Such mounting of forming member 44 is achieved by reversing the orientation of recess 60 relative to the mandrel from that shown in FIG. 1 and inserting pin 52 through opening 50 in the forming member and the appropriate opening 42 in arm 40. Thus, it will be appreciated that a wide variety of mandrel and forming member combinations can be accommodated to enable the bending of a wide range of tube diameters, namely from 12 mm to 35 mm and including tubes of steel, stainless steel, hard and soft copper and plastic coated steel.

Figure 2:
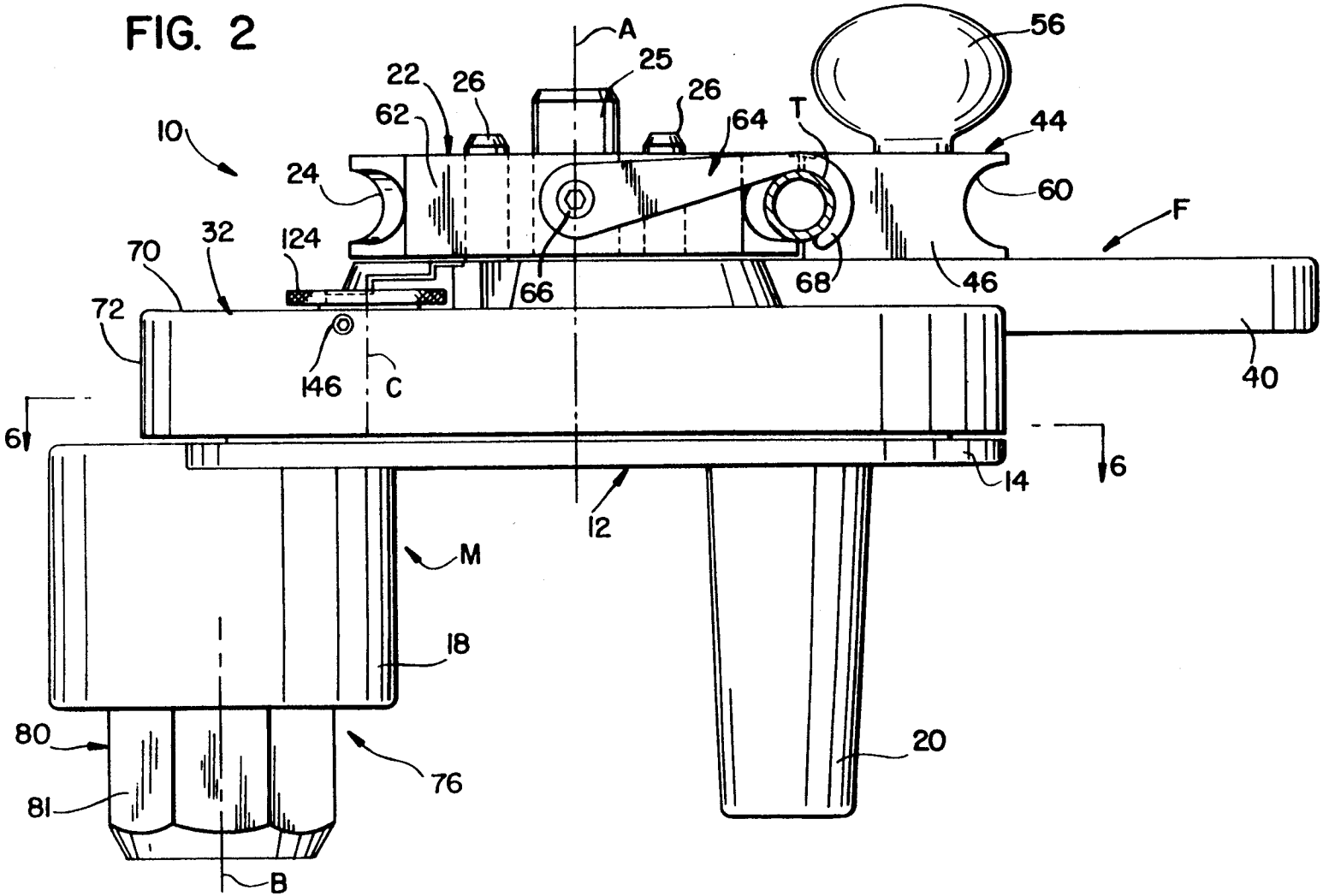
FIG. 2 is a side elevation view of the apparatus looking in the direction of line 2—2 in FIG. 1.
Figure 3:
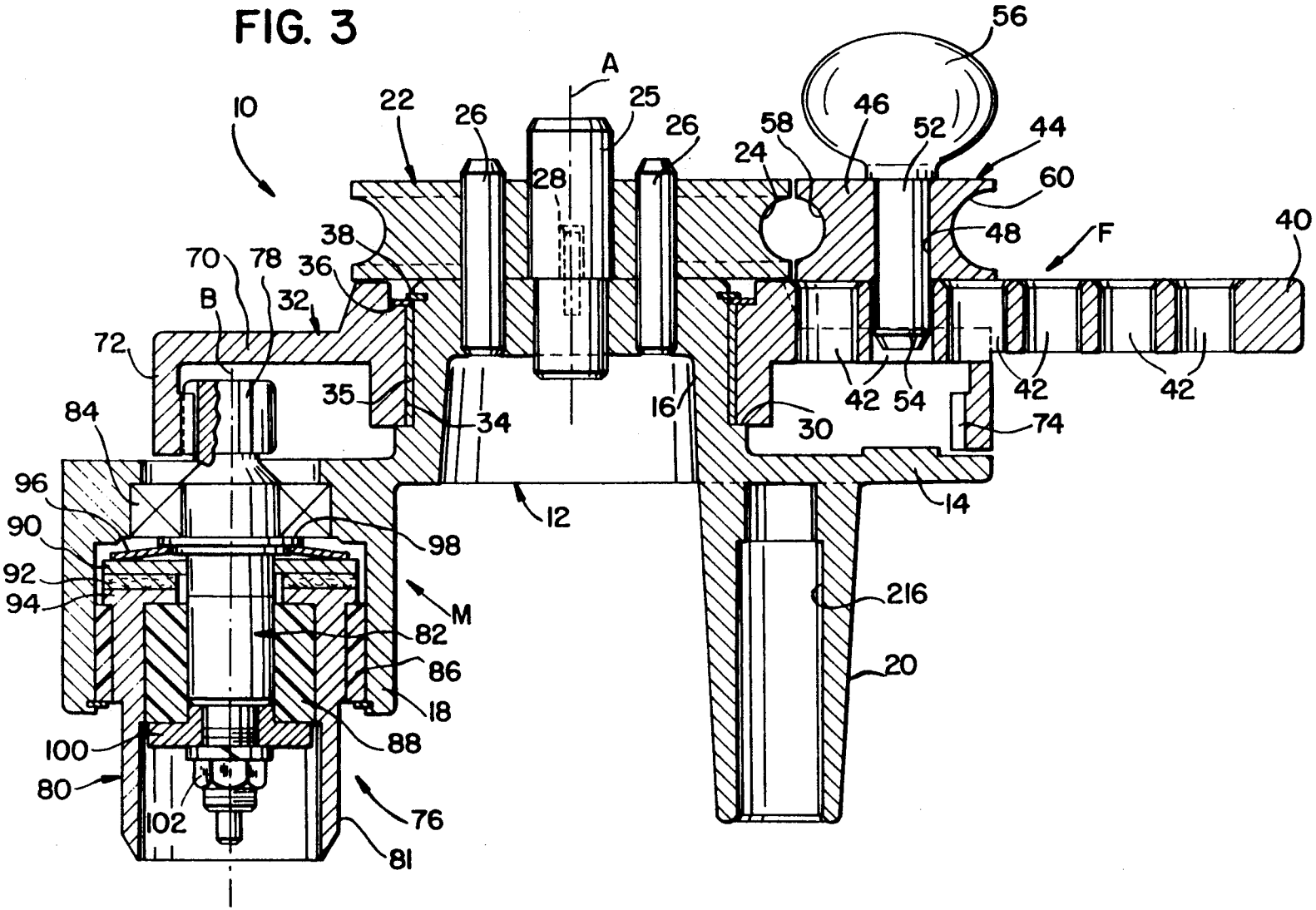
FIG. 3 is a sectional elevation view of the apparatus taken along line 3—3 in FIG. 1.

Mandrel 22 has a flat face 62 radially spaced from and parallel to axis A and provided with a tube holding arm 64 which is pivotally mounted against face 62 by means of a bolt 66. Arm 64 has a hooked end 68 which, as is well known, is adapted to engage about a tube T to be bent so as to preclude radial and axial displacement of the tube relative to the mandrel during a bending operation. In the embodiment illustrated, as shown in FIGS. 1 and 2, tube T to be bent is disposed between bending groove 24 of mandrel 22 and recess 58 of forming member 44 with the adjacent portion of tube T captured by hooked end 68 of arm 64. As described hereinafter, forming member 44 is then angularly displaced relative to mandrel 22 counterclockwise about bend axis A in FIG. 1, whereby tube T is progressively urged into bending groove 24 and the tube is bent to a desired bend angle determined by the extent of angular displacement of the forming member relative to the mandrel.

In the embodiment illustrated, displacement of forming member 44 about axis A and relative to mandrel 22 to bend tube T is achieved by driving upper support 32 and thus arm 40 and forming member 44 relative to support 12 and thus mandrel 22. More particularly in this respect, as best seen in FIGS. 1 and 2, upper support member 32 includes a radially extending wall 70 terminating in an axially extending peripheral skirt 72 coaxial with axis A. The radially inner side of skirt 72 is provided with gear teeth 74 extending circumferentially thereabout. A drive shaft assembly 76 is mounted in sleeve portion 18 of support 12 and includes a pinion gear 78 in meshing engagement with teeth 74 and adapted to be rotated about a drive shaft axis B to displace support 32 about axis A. More particularly, drive shaft assembly 76 includes coaxial input and output shafts 80 and 82, respectively. Pinion gear 78 is integral with output shaft 82 for rotation therewith, and output shaft 82 is supported for rotation about axis B by a ball bearing unit 84. Input shaft 80 is tubular and has an octagonal outer coupling surface 81 at its lower end which provides for coupling the input shaft with a drive unit as set forth more fully hereinafter, and the input shaft is supported for rotation about axis B and relative to output shaft 82 by sleeve bearings 86 and 88. A slip clutch is interposed between input shaft 80 and output shaft 82 and comprises a clutch pressure plate 90 and a clutch friction plate 92 interposed between plate 90 and radial flange 94 on the inner end of input shaft 80. Clutch plate 90 is axially slidably mounted on output shaft 82 and the latter and the opening through the clutch plate are provided with flats, not shown, whereby the clutch plate rotates with the output shaft. The bottom side of clutch plate 90 is serrated, and spring washer 96 is interposed between a flange 98 on output shaft 82 and clutch plate 90 and biases the clutch plate 90 and friction plate 92 against flange 94 of input shaft 80. A retaining collar 100 and nut 102 at the lower end of output shaft 82 operate to axially compress spring washer 96 and thus control the torque required to cause slippage between the input and output shafts. More particularly in this respect, the clutch pressure plate engages friction plate 92 against flange 94 of the input shaft so as to provide for slippage between flange 94 and friction plate 92 when the input torque exceeds a magnitude determined by the biasing force of spring washer 96. The function and operation of the slip clutch in this respect is set forth more fully hereinafter.

As will be appreciated from the description thus far, rotation of pinion 78 in opposite directions imparts angular displacement to upper support 32 and thus arm 40 and forming member 44 in opposite directions relative to mandrel 22 and bend axis A. One of the two directions, counterclockwise in FIG. 1, provides for bending a tube T between mandrel groove 24 and forming member recess 58 to a desired bend angle, and the other direction provides for reversing the direction of the forming member so as to release the bent tube and return the forming member to an initial bend starting position as more fully described hereinafter.

In accordance with the present invention, an improved arrangement is provided for selecting a bend angle for a tube to be bent by relative displacement between the mandrel and forming member and positively stopping the angular displacement therebetween when the selected bend angle is reached. In the preferred embodiment, and as best seen in FIGS. 1 and 4–7 of the drawing, such selectivity and positive stopping is achieved by a plurality of abutment blocks 104, 106, 108 and 110 integral with bottom wall 14 of lower support 12 on the inner side thereof, and an adjustable stop member 114 on radial wall 70 of forming member support 32. More particularly, each of the abutment blocks 104–110 includes a corresponding abutment surface 104*a*–110*a* and each of the abutment surfaces is a planar surface parallel to and extending radially of bend axis A. As will become apparent hereinafter, abutment surface 104*a* defines a bend starting position with respect to the direction of relative displacement between mandrel 22 and forming member 44 during a tube bending operation. Abutment surfaces 106*a*, 108*a* and 110*a* are angularly spaced apart about axis A and from abutment surface 104*a* an angular distance corresponding to the angular displacement of forming member 44 relative to mandrel 22 to provide bend angles of 45°, 90° and 180°, respectively. For the purpose set forth hereinafter, abutment surfaces 106*a*, 108*a* and 110*a* are progressively axially stepped upwardly relative to the inner surface of bottom wall 14.

Figure 4:
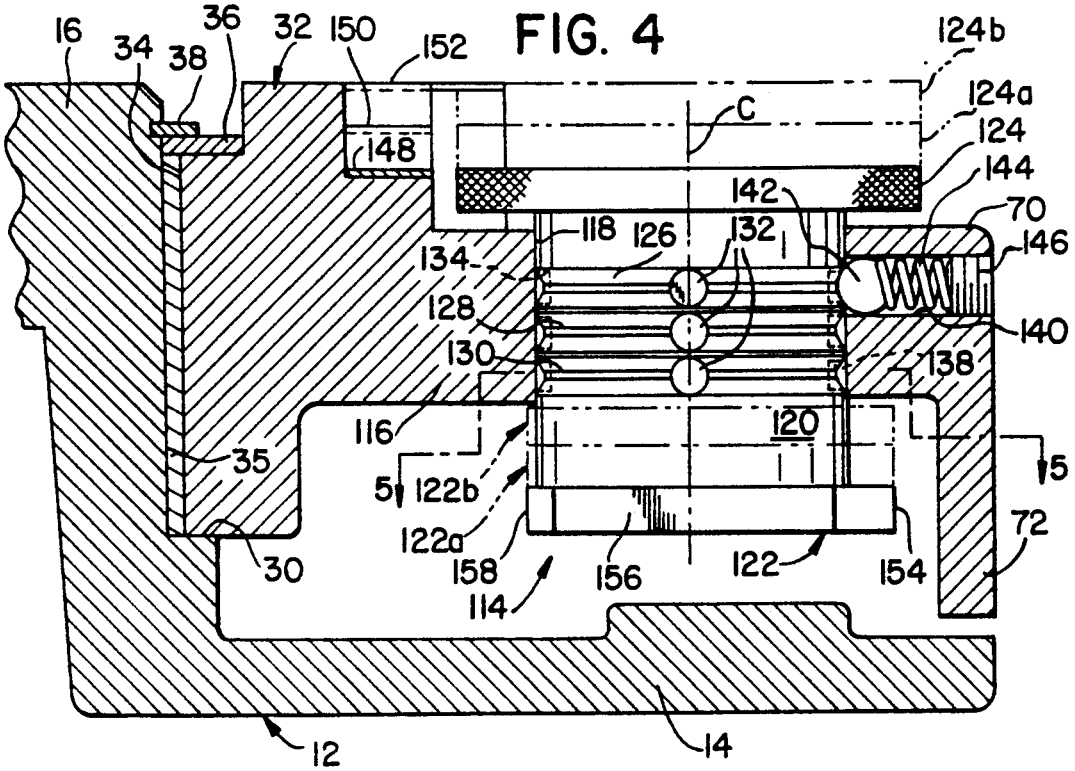
FIG. 4 is a detailed sectional elevation view taken along line 4—4 in FIG. 1 and showing the stop member of the apparatus.
Figure 7:
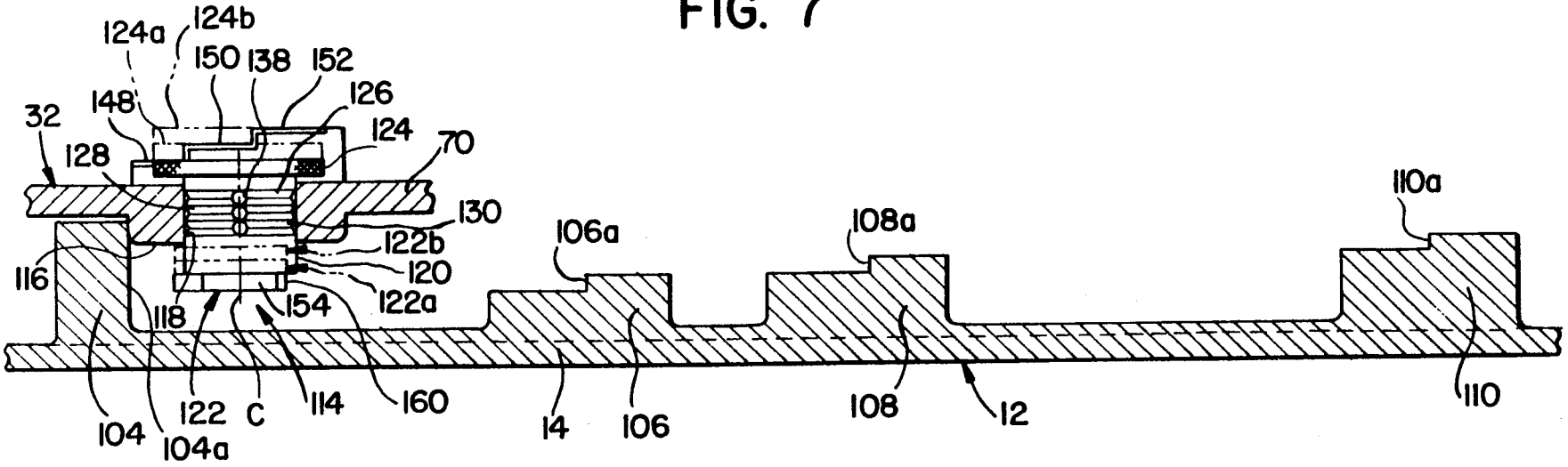
FIG. 7 is a schematic illustration of the positional relationships between the stop member and abutment surfaces as seen when looking in the direction of line 7—7 in FIG. 1.

As best seen in FIGS. 4 and 7, the underside of wall 70 of support 32 includes a downwardly extending boss 116, and stop member 114 includes a cylindrical body portion 120 extending downwardly through an opening 118 therefor in wall 70 and boss 116. Body portion 120 has an axis C parallel to bend axis A and includes a stop element 122 at the lower end of the body portion and an operating knob 124 at the upper end thereof. The opening through wall 70 and boss 116 supports body portion 120 and thus stop element 122 for axial and rotational displacement relative to axis C. Body portion 120 is provided with axially spaced apart peripheral recesses 126, 128 and 130 and, for the purpose set forth hereinafter, each recess is provided with four radially inwardly extending bores 132, 134, 136 and 138. Numerically corresponding ones of the bores are axially aligned relative to body portion 120, and the bores in each recess are in diametrically opposed pairs. Stop member 114 is adapted to be selectively adjusted axially relative to supports 12 and 32 to any one of the plurality of positions corresponding to recesses 126, 128 and 130 and to be releasably held in a selected one of the positions. In the embodiment illustrated, stop member 114 is releasably held in a selected axial position by a spring biased detent arrangement. More particularly in this respect, skirt 72 of support 32 adjacent opening 116 is provided with a radial bore 140 therethrough receiving a ball 142 which is biased radially inwardly of body portion 120 of the stop member by a spring 144 which is compressed between ball 142 and a set screw 146 received in a threaded outer portion of bore 140. Accordingly, it will be appreciated that body portion 120 is adapted to be axially displaced relative to wall 70 through the use of operating knob 124 and that the ball detent is adapted to engage in a selected one of the recesses 126, 128 and 130 to releasably hold stop member 114 in the corresponding axial position.

Each of the selectable axial positions for stop member 114 corresponds to a different one of the bend angles represented by abutment surfaces 106*a*, 108*a* and 110*a*, and in each of the stop member positions, stop element 122 on the lower end of body portion 120 is axially positioned in alignment with the corresponding abutment surface. More particularly in this respect and as will be appreciated from FIGS. 4 and 7, when detent ball 142 is engaged in recess 126 stop element 122 is axially aligned with abutment surface 106*a* which, as mentioned hereinabove, corresponds to a bend angle of 45° for a tube to be bent. When stop member 114 is displaced axially upwardly for detent ball 142 to engage in recess 128 stop element 122 is in the broken line position designated 122*a* in FIGS. 4 and 7 and is in axial alignment with abutment surface 108*a* corresponding to a bend angle of 90°. Similarly, when stop member 114 is axially positioned for detent ball 142 to engage in recess 130, stop element 122 is in the broken line position designated 122*b* in FIGS. 4 and 7 and is in axial alignment with abutment surface 110*a* which corresponds to a bend angle of 180°. As will be appreciated from FIGS. 1, 4 and 7, the portion of upper support 32 radially inwardly adjacent operating knob 124 is provided with stepped surfaces 148, 150 and 152 which are respectively coplanar with the upper surface of operating knob 124 when the stop member 114 is respectively in the 45°, 90° and 180° bend angle positions thereof. The solid line position of knob 124 in FIG. 4 is the 45° bend angle position, and the broken line positions designated 124*a* and 124*b* are the 90° and 180° bend angle positions, respectively, for the knob. This arrangement advantageously provides a visual indication of the bend angle setting at any time.

Figure 6:
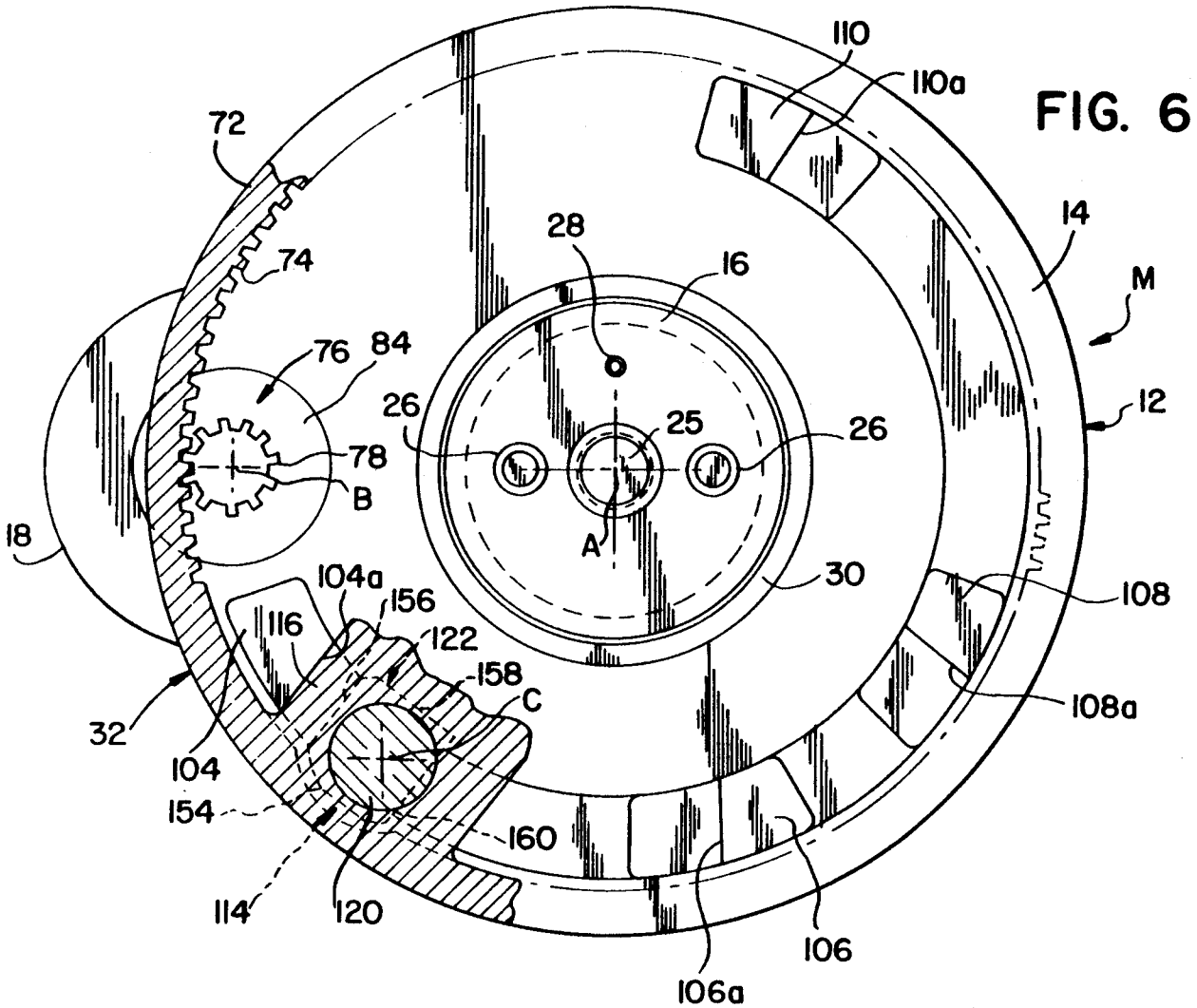
FIG. 6 is a plan view of the lower support member of the apparatus taken along line 6—6 in FIG. 2.

To bend a tube to a bend angle of 45°, for example, the component parts of the bending apparatus are initially positioned as shown in FIGS. 1, 6 and 7 with boss 116 engaging abutment surface 104*a*, which defines the starting position, and with stop element 122 in axial alignment with abutment surface 106*a*. With the tube T interposed between mandrel 22 and forming member 44 as described hereinabove, support 32 is driven counterclockwise in FIG. 1 by an operator controlled drive unit described hereinafter so as to angularly displace forming member 44 counterclockwise about axis A and relative to mandrel 22 to urge the tube T therebetween into bending groove 24. Since upper support 32 is angularly displaced relative to lower support 12, it will be appreciated that stop member 114 is angularly displaced with support 32 relative to support 12 and thus the abutment surfaces thereon. When such relative displacement brings stop element 122 into engagement with abutment surface 106*a* corresponding to a 45° bend angle, relative displacement of the forming member relative to mandrel 22 is positively stopped, whereupon the operator de-energizes the drive unit. During the period between engagement of stop element 122 with abutment surface 106*a* and stopping of the drive unit, the slip clutch in drive shaft assembly 76 operates to preclude the imposition of excessive force between the stop element and abutment surface as well as the imposition of undesirable torque on the component parts of the drive unit and drive shaft assembly 76. Upon completing the bend, the drive unit is actuated to reverse the direction of angular displacement of support 32 relative to support 12, thus to return forming member 44 to the start position which, as stated above, is determined by engagement between boss 116 and abutment surface 104*a*.

If it is desired to bend a tube to a bend angle of 90° or 180°, stop member 114 is axially positioned for detent ball 142 to engage in recesses 128 and 130, respectively. These positions respectively axially align stop element 122 with abutment surfaces 108*a* and 110*a* as indicated by the broken line positions 122*a* and 122*b* for the stop element in FIG. 7. Bending then takes place as described above with relative displacement between the forming member and mandrel being positively stopped upon engagement of stop element 122 with the abutment surface corresponding to the selected bend angle. After each bending operation, the component parts are returned to the bend starting position as described above.

Figure 5:
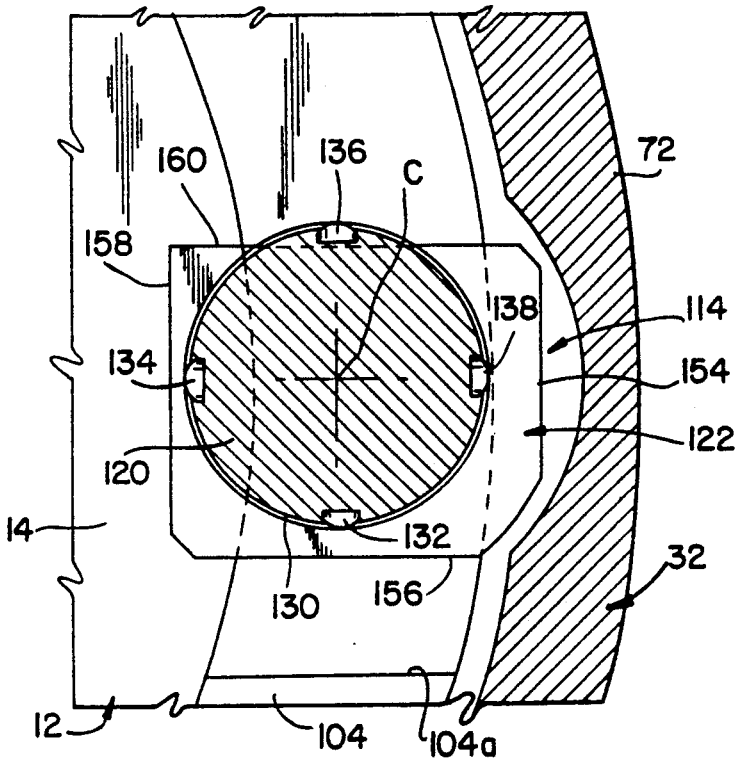
FIG. 5 is a detail plan view in section, taken along line 5—5 in FIG. 4 and showing the stop element of the stop member.

Preferably, as best seen in FIG. 5, stop element 122 has an outer periphery which is eccentric with respect to axis C and provides a plurality of stop surfaces each of which is selectively engageable with each of the abutment surfaces 106*a*, 108*a* and 110*a*. The stop surfaces provide for, selectively, not overbending a tube or overbending a tube to any one of a plurality of overbend angles relative to the corresponding bend angle represented by the abutment surfaces. In the embodiment illustrated, such selectivity is achieved by providing stop element 122 with stop surfaces 154, 156, 158 and 160 each of which is parallel to axis C and spaced a different radial distance therefrom. In the embodiment illustrated, stop surfaces 154, 156, 158 and 160 respectively provide for no overbend and overbends of 1°, 2° and 4° with respect to each of the selectable bend angles. As seen in FIG. 1, the upper side of operating knob 124 is provided with indicia indicative of the selectable overbend positions for stop element 122, and the adjacent surface 150 of support 32 is provided with an arrow 162 to indicate the overbend position of stop element 122 at any time. As will be appreciated from the foregoing description, stop member 122 is rotatable about axis C, by means of knob 124, to provide for selectively positioning any one of the stop surfaces for engagement with any one of the abutment surfaces 106*a*, 108*a*, and 110*a*. As will be further appreciated from FIGS. 4 and 5, bores 132, 134, 136 and 138 associated with each of the recesses in body member 120 of stop member 114 are positioned therein so as to be cooperable with detent ball 142 to releasably hold stop surfaces 154, 156, 158 and 160, respectively, in position for engagement with a selected one of the abutment surfaces 106*a*, 108*a* and 110*a*.

With stop member 114 positioned relative to supports 12 and 32 as shown in FIGS. 4 and 5 of the drawing, stop element 122 is axially positioned relative to the supports for engagement with abutment surface 106*a* representing a bend angle of 45° and is angularly related to axis C for stop surface 160 to be positioned for facial engagement with abutment surface 106*a*, thus to provide an overbend of 4°. It will be appreciated from the foregoing description that stop member 114 can be rotated about axis C from the position shown in FIG. 5 to selectively position any one of the other stop surfaces 154, 156 and 158 for engagement with abutment surface 106*a*, thus to respectively provide no overbend or an overbend of 1° or 2°. As a further example, if a tube is to be bent to a bend angle of 180°, the operator will axially displace stop member 114 upwardly from the solid line position of knob 124 shown in FIG. 4 to the broken line position designated 124*b* in which the upper surface of the knob is coplanar with surface 152 on upper support 32. In this position of stop member 114, detent ball 142 engages in recess 130 so as to axially align stop element 122 with abutment surface 110*a*. If then, for example, it is desired to overbend the tube 2°, the operator will rotate stop member 114 until the 2° mark on knob 124 is aligned with arrow 162 on surface 150 of upper support 32. In this position of stop member 114, detent ball 142 enters bore 136 associated with recess 130, thus to align stop surface 158 with abutment surface 110*a*. The tube will then be bent in the manner described hereinabove and, upon completion of the bending operation, the overbend will provide for the tube to spring back to provide the desired bend angle of 180°.

Figure 8:
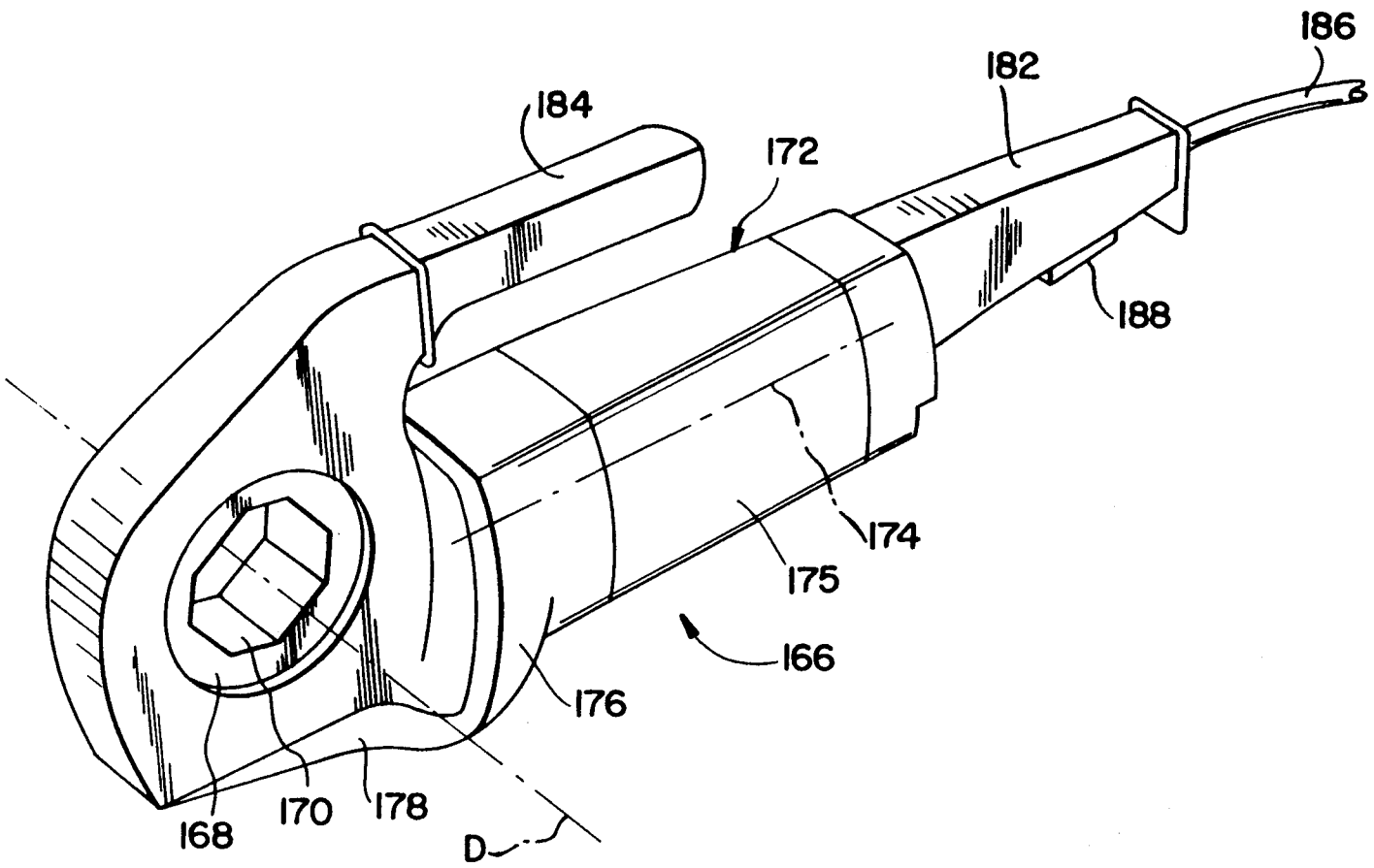
FIG. 8 is a perspective view of the drive unit.
Figure 9:
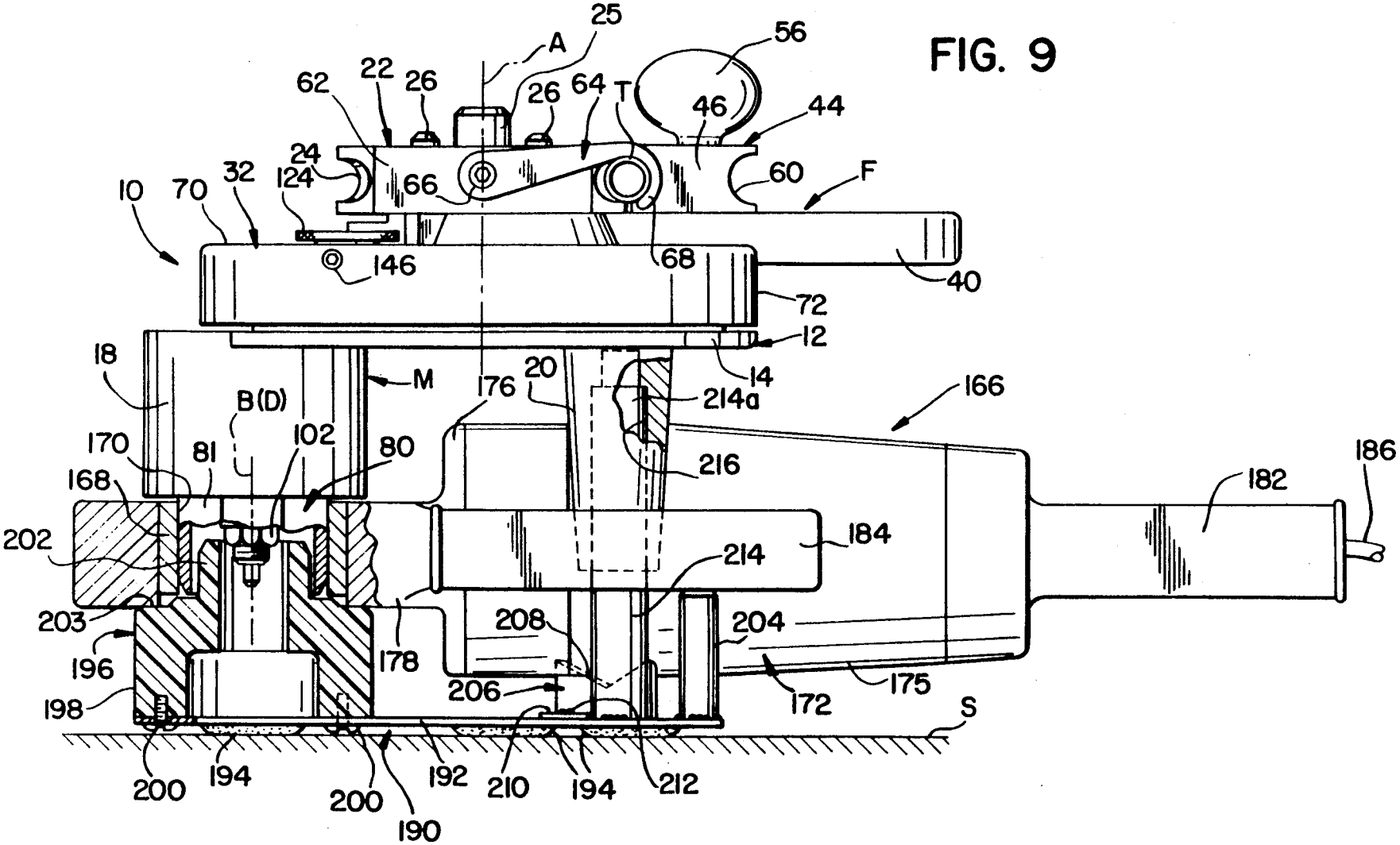
FIG. 9 is an elevation view, partially in section, showing the bending apparatus, drive unit and stand in assembled relationship.
Figure 10:
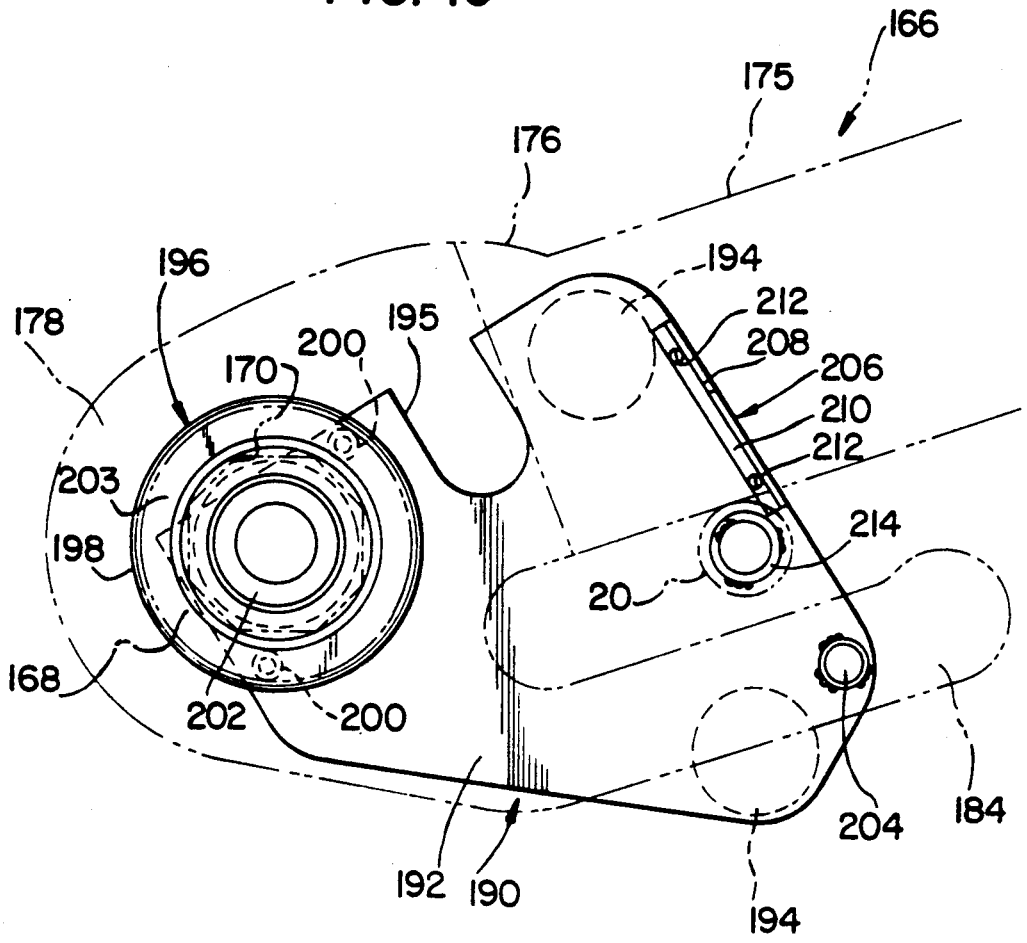
FIG. 10 is a plan view of the support stand showing the drive unit thereon in phantom.

In accordance with the preferred embodiment, tube bending apparatus 10 is adapted to be driven by means of an electrically powered drive unit and, as shown by FIGS. 8–10, the latter and bending apparatus 10 are adapted to be assembled relative to one another and to a ground, bench or stand supported base by which the driving unit and bending apparatus are supported during a bending operation. More particularly, with reference to FIGS. 8–10, the lower octagonal coupling portion 81 of input drive shaft 80 is adapted to be rotated about axis B by a drive unit 166 which includes octagonal opening 170 adapted to slidably interengage with coupling portion 81. Drive units of the character represented by numeral 166 are well known in the pipe threading industry and, in the embodiment herein disclosed, the drive unit is a commercially available power drive sold by the Ridge Tool Company of Elyria, Ohio under the latter's product designation No. 600 Power Drive. The structure and operation of such drive units is well known and need not be described in detail herein. Briefly, with reference in particular to FIG. 8, the drive unit includes an elongated housing 172 having an axis 174. Housing 172 includes a portion 175 enclosing an electric motor, not shown, a portion 176 enclosing a gear reduction unit, not shown, and a housing portion 178 enclosing drive ring 168. Drive ring 168 has an axis D transverse to axis 174 and, when assembled with bending apparatus 10, coaxial with drive shaft axis B.

The drive unit housing further includes a handle portion 182 extending rearwardly from housing portion 174, and a front handle 184 extending rearwardly from housing portion 178 and spaced above housing portion 175. Power cord 186 facilitates connecting the drive unit to a source of electricity. A three position switch 188 provides for operating the electric motor in opposite directions, thus to rotate drive ring 168 in opposite directions about axis D. As is still further well known, the octagonal interior 170 of drive ring 168 is adapted to slidably receive and rotatably drive a coupling component such as drive coupling portion 81 of input drive shaft 80. Thus, in connection with the present invention, drive unit 166 can be readily separated from drive coupling 81 to facilitate handling and transportation of the drive unit and the bending apparatus. As will be appreciated from the foregoing description, drive unit 166 is adapted to rotate drive shaft assembly 76 about drive shaft axis B upon actuation of switch 188, whereby input shaft 80 drives output shaft 82 and thus pinion 78 through the slip clutch.

Referring in particular to FIGS. 9 and 10, bending apparatus 10 and drive unit 166 are adapted to be separably interengaged with one another and with a support base 190 by which the bending apparatus and drive unit are supported on an underlying support surface S, such as a bench, during a bending operation. Base 190 includes a base plate 192 provided with a plurality of rubber grommets 194 which serve to restrain sliding of the assembly relative to surface S during a tube bending operation. If desired, base 190 can be releasably secured to a ground supported stand through the use of a suitable fastener received in a notch 195 in base plate 192. The base further includes a tubular support post 196 of nylon or the like having a lower cylindrical body 198 suitably secured to base plate 192, such as by screws 200, and an upwardly extending cylindrical neck portion 202 of smaller diameter than body 198 and providing a shoulder 203 therewith. The portion of housing 178 of drive unit 166 surrounding drive ring 168 is adapted to rest on shoulder 203, and the outside diameter of neck portion 202 is less than the inner diameter of coupling portion 81 of input shaft 80 for bending apparatus 10. Accordingly, as will be appreciated from FIG. 9, neck portion 202 is coaxial with axis D of drive unit 166 and axis B of input shaft coupling portion 81 and functions during a bending operation to preclude lateral separation of coupling 81 and drive ring 168 of drive unit 166 from support post 196.

Base 190 further includes an upstanding tubular post 204 secured to base plate 192 such as by welding and having an upper end underlying and engaged by handle 184 of drive unit 166, and a support cradle 206 which includes an upstanding V-shaped cradle plate 208 having a mounting flange 210 along the bottom thereof and by which the cradle is secured to base plate 192, preferably through the use of removable fasteners 212. Cradle 208 engages under housing portion 175 of drive unit 166 and, together with post 204, horizontally supports drive unit 166 so as to maintain a coaxial relationship between axis B of bending apparatus 10 and axis D of drive coupling 168. Base 190 further includes an upstanding tubular post 214 secured to base plate 192 such as by welding. Post 214 extends upwardly from the base plate between housing portion 175 and handle 184 of drive unit 166 and has an upper end 214*a* axially slidably received in a bore 216 provided therefor in post 20 depending from the bottom of lower support 12. Posts 20 and 214, in being so positioned relative to housing portion 175 and handle 184 of drive unit 166 and in being interengaged with one another and thus bending apparatus 10, provide a reaction arm which precludes relative rotational displacement between the drive unit and bending apparatus about axes B and D when the drive unit is actuated to rotate drive collar 168 and thus coupling portion 81 of input shaft 80 in opposite directions about axes B and D. As will be appreciated from FIG. 9 and the foregoing description, the bending apparatus, drive unit and support base are adapted to be readily assembled and disassembled, thus to enhance the portability thereof as well as access to the components for maintenance purposes. Further, as will be appreciated from the description herein of bending apparatus 10, when the bending apparatus, drive unit and support base are assembled as shown in FIG. 9, drive unit switch 188 is adapted to be actuated by an operator to impart rotation to drive ring 168 about axis D and thus rotation of input shaft 80 of bending apparatus 10 about axis B to angularly displace upper support 32 and thus forming member 44 about axis A relative to lower support 12 and mandrel 22 so as to bend a tube T disposed between the mandrel and forming member. When such angular displacement reaches the point of the preselected bend angle, the angular displacement of positively stopped as described hereinabove, whereupon the operator releases switch 188 to de-energize the power unit. During the interval between such positive stopping of the angular displacement and de-energizing of the drive unit, the slip clutch in the drive shaft assembly of bending apparatus 10 slips to preclude the imposition of undesirable forces on the component parts of the bending apparatus and drive unit.

While considerable emphasis has been placed on the structures and structural interrelationships between the component parts of the preferred embodiment herein illustrated and described, it will be appreciated that many embodiments of the invention can be made and that many changes can be made in the preferred embodiment without departing from the principles of the invention. In this respect, for example, relative displacement between the mandrel and forming member can be achieved other than by the detachable electric motor drive unit and could, for example, be achieved through the use of a detachable hand operated lever or other motorized drive arrangement. Furthermore, driving displacement between the drive shaft and forming member support could be achieved through a pinion gear and ring gear arrangement in which the drive shaft would be rotatable about a drive shaft axis transverse to the bend axis rather than parallel thereto. Further, it will readily appreciated that the invention is applicable to bending apparatus in which the relative displacement between the mandrel and forming member is achieved by rotating the mandrel relative to a fixed forming member. Still further, it will be appreciated in the embodiment illustrated that the relationship between the abutment surfaces and stop member can be reversed relative to the opposed inner surfaces of the supports 12 and 32 such that the abutment surfaces would be provided on the inner side of upper support 32 and the stop member would be axially and rotatably supported on bottom wall 14 of lower support 12 so as to extend upwardly therefrom for cooperative alignment with the abutment surfaces. In either event, it will be appreciated too that the abutment surfaces could be provided other than as shown in connection with the preferred embodiment and, for example, by abutment members separate from and attached to the inner surface of wall 14 of support 12. Still further, it will be appreciated that abutment surfaces can be provided for bend angles other than or in addition to those disclosed in conjunction with the preferred embodiment, and that the stop member can be provided with a stop element having an eccentric peripheral surface contour other than that illustrated herein and which would provide for other or additional degrees of overbend in conjunction with operation of the apparatus. These and other modifications of the preferred embodiment as well as other embodiments of the invention will be apparent to those skilled in the art, whereby it is to be distinctly understood that the foregoing descriptive matter is to be interpreted merely as illustrative of the present invention and not as a limitation.

Having thus described the invention it is claimed:

1. In a tube bender comprising mandrel means providing a bending groove extending about a bend axis, forming means, means supporting said mandrel means and forming means for relative angular displacement about said bend axis, whereby a tube between said mandrel means and said forming means is urged into said bending groove during said relative angular displacement, means to relatively displace said mandrel means and said forming means, and means for limiting said relative angular displacement during a bending operation, the improvement comprising: said means for limiting relative angular displacement including means providing a plurality of abutment surfaces on one of said mandrel means and forming means angularly spaced apart relative to said bend axis, stop means on the other of said mandrel means and forming means adjustable to selectively engage any one of said plurality of abutment surfaces, and means to preclude relative angular displacement between said mandrel means and said forming means immediately upon engagement of said stop means with said any one of said abutment surfaces.

2. A tube bender according to claim 1, wherein said plurality of abutment surfaces are stepped in a given direction relative to said bend axis and said stop means is adjustable in said given direction for alignment with said abutment surfaces.

3. A tube bender according to claim 2, wherein said given direction is axial relative to said bend axis.

4. A tube bender according to claim 2, wherein each of said abutment surfaces corresponds to a different bend angle to be imparted to a tube during said relative angular displacement between said mandrel means and forming means, and said stop means includes means cooperable with each of said abutment surfaces for overbending said tube relative to the corresponding bend angle.

5. A tube bender according to claim 3, wherein said given direction is axial relative to said bend axis, and said means cooperable with each of said abutment surfaces is rotatably adjustable about an axis parallel to said bend axis for selectively overbending said tube to any one of a plurality of different overbend angles relative to said corresponding bend angle.

6. A tube bender according to claim 1, wherein said abutment surfaces are on said mandrel means and said stop means is on said forming means.

7. A tube bender according to claim 6, wherein said plurality of abutment surfaces are stepped in a given direction relative to said bend axis and said stop means is adjustable in said given direction for alignment with said abutment surfaces.

8. A tube bender according to claim 7, wherein said given direction is axial relative to said bend axis.

9. A tube bender according to claim 8, wherein each of said abutment surfaces corresponds to a different bend angle to be imparted to a tube during said relative angular displacement between said mandrel means and forming means, and said stop means includes means cooperable with each of said abutment surfaces for overbending said tube relative to the corresponding bend angle.

10. A tube bender according to claim 9, wherein said means cooperable with each of said abutment surfaces includes eccentric means rotatable about an axis parallel to said bend axis for selectively overbending said tube to any one of a plurality of different overbend angles relative to said corresponding bend angle.

11. A tube bender according to claim 1, wherein said means to relatively displace said mandrel means and said forming means includes drive means for angularly displacing one of said mandrel means and said forming means about said bend axis and relative to the other of said mandrel means and forming means.

12. A tube bender according to claim 11, wherein said drive means includes drive shaft means, and means drivably interengaging said drive shaft means and said one of said mandrel means and said forming means.

13. A tube bender according to claim 12, wherein said drive shaft means includes coaxial input and output drive shaft means and slip clutch means therebetween, said slip clutch means providing said means to preclude relative displacement between said mandrel means and said forming means.

14. A tube bender according to claim 12, wherein said drive shaft means is rotatable about an axis parallel to said bend axis and includes coaxial input and output drive shaft means and slip clutch means therebetween, said output drive shaft means being drivably interengaged with said one of said mandrel means and forming means and said slip clutch means providing said means to preclude relative displacement between said mandrel means and said forming means.

15. A tube bender according to claim 11, wherein said forming means and said mandrel means respectively are said one and said other of said mandrel means and forming means.

16. A tube bender according to claim 15, wherein said forming means includes forming member support means angularly displaceable relative to said mandrel means and forming member means mounted on said forming member support means for displacement therewith, said drive means and said forming member support means having interengaging means for said drive means to angularly displace said forming member support means.

17. A tube bender according to claim 16, wherein said mandrel means includes mandrel member support means and a mandrel member mounted on said mandrel member support means, said plurality of abutment surf aces being on said mandrel member support means and said stop means being on said forming member support means.

18. In a tube bender comprising mandrel means providing a bending groove extending about a bend axis, forming means, means supporting said mandrel means and forming means for relative angular displacement about said bend axis, whereby a tube between said mandrel means and said forming means is urged into said bending groove during said relative angular displacement, means to relatively displace said mandrel means and said forming means, and means for limiting said relative angular displacement during a bending operation, the improvement comprising: said means for limiting relative angular displacement including means providing a plurality of abutment surfaces on one of said mandrel means and forming means angularly spaced apart relative to said bend axis, stop means on the other side of said mandrel means and forming means adjustable to selectively engage any one of said plurality of abutment surfaces, each of said abutment surfaces corresponding to a different bend angle to be imparted to a tube during said relative angular displacement between said mandrel means and forming means, and said stop means including means cooperable with each of said abutment surfaces to overbend said tube relative to the corresponding bend angle.

19. A tube bender according to claim 18, wherein said means cooperable with each of said abutment surfaces is adjustable for selectively overbending said tube to any one of a plurality of different overbend angles relative to said corresponding bend angle.

20. In a tube bender comprising mandrel means providing a bending groove extending about a bend axis, forming means, means supporting said mandrel means and forming means for relative angular displacement about said bend axis, whereby a tube between said mandrel means and said forming means is urged into said bending groove during said relative angular displacement, means to relatively displace said mandrel means and said forming means, and means for limiting said relative angular displacement during a bending operation, the improvement comprising: said means for limiting relative angular displacement including means providing a plurality of abutment surfaces said forming means angularly spaced apart relative to said bend axis, stop means on said mandrel means and adjustable to selectively engage any one of said plurality of abutment surfaces, said means to relatively displace said mandrel means and said forming means including drive means for angularly displacing said forming means about said bend axis and relative to said mandrel means, said forming means including forming member support means angularly displaceable relative to said mandrel means and forming member means mounted on said forming member support means for displacement therewith, said drive means and said forming member support means having interengaging means for said drive means to angularly displace said forming member support means, said mandrel means including mandrel member support means and a mandrel member mounted on said mandrel member support means, said plurality of abutment surfaces being on said mandrel member support means and said stop means being on said forming member support means, said mandrel member support means and said forming member support means being coaxial and including axially opposed inner sides, said plurality of abutment surfaces being on the inner side of said mandrel support means, and said stop means extending inwardly of the inner side of said forming member support means.

21. A tube bender according to claim 20, wherein said plurality of abutment surfaces are stepped axially relative to said bend axis, and said stop means is axially adjustable relative to said forming member support means for selective alignment with said abutment surfaces.

22. A tube bender according to claim 20, wherein each of said abutment surf aces corresponds to a different bend angle to be imparted to a tube during said relative angular displacement between said mandrel means and forming means, and said stop means includes means cooperable with each of said abutment surfaces to overbend said tube relative to the corresponding bend angle.

23. A tube bender according to claim 22, wherein said means cooperable with each of said abutment surfaces is adjustable for selectively overbending said tube to any one of a plurality of different overbend angles relative to said corresponding bend angle.

24. A tube bender according to claim 23, wherein said plurality of abutment surfaces are stepped axially relative to said bend axis, and said stop means is axially adjustable relative to said forming member support means for selective alignment with said abutment surfaces.

25. A tube bender according to claim 24, wherein said stop means includes eccentric means providing said means cooperable with each of said abutment surf aces for selectively overbending said tube, said eccentric means being rotatable about an axis parallel to said bend axis to selectively position said eccentric means relative to each of said abutment surfaces for selectively overbending said tube to any one of a plurality of different overbend angles relative to the corresponding bend angle.

26. A tube bender according to claim 20, wherein said drive means includes drive shaft means rotatable about an axis parallel to said bend axis and including coaxial input and output drive shaft means and slip clutch means therebetween, said output drive shaft means being drivingly interengaged with said forming member support means.

27. A tube bender according to claim 26, wherein said plurality of abutment surfaces are stepped axially relative to said bend axis, and said stop means is axially adjustable relative to said forming member support means for selective alignment with said abutment surf aces, and wherein each of said abutment surfaces corresponds to a different bend angle to be imparted to a tube during said relative angular displacement between said mandrel means and forming means, and said stop means includes means cooperable with each of said abutment surfaces to overbend said tube relative to the corresponding bend angle.

28. A tube bender according to claim 27, wherein said means cooperable with each of said abutment surfaces is adjustable for selectively overbending said tube to any one of a plurality of different overbend angles relative to said corresponding bend angle, and wherein said stop member means includes eccentric means providing said means cooperable with each of said abutment surfaces for selectively overbending said tube, said eccentric means being rotatable about an axis parallel to said bend axis to selectively position said eccentric means relative to each of said abutment surfaces for selectively overbending said tube to any one of a plurality of different overbend angles relative to the corresponding bend angle.

29. A tube bender comprising first support means, mandrel means on said first support means and having a bending groove extending about a bend axis, second support means mounted on said first support means for angular displacement relative thereto about said bend axis, forming member means mounted on said second support means for angular displacement therewith about said bend axis and relative to said mandrel means, whereby a tube between said mandrel means and said forming member means is urged into said bending groove during angular displacement of said second support means relative to said first support means, means to angularly displace said second support means relative to said first support means about said bend axis, means providing a plurality of abutment surfaces on one of said first and second support means, said abutment surfaces being angularly spaced apart about said bend axis and each said abutment surface corresponding to a different one of a plurality of bend angles to which a tube can be bent during said angular displacement of said second support means relative to said first support means, stop means on the other of said first and second support means, said stop means being adjustable to selectively engage any one of said plurality of abutment surfaces to limit said angular displacement of said second support means relative to said first support means during a tube bending operation, and means to preclude relative angular displacement between said first and second support means immediately upon engagement of said stop means with said any one of said abutment surfaces.

30. A tube bender according to claim 29, wherein said stop means includes means cooperable with each of said abutment surfaces to overbend said tube relative to the bend angle for the corresponding abutment surface.

31. A tube bender according to claim 30, wherein said means cooperable with each of said abutment surfaces is adjustable for selectively overbending said tube to any one of a plurality of different overbend angles relative to said bend angle for the corresponding abutment surface.

32. A tube bender according to claim 29, wherein said mandrel means is removably supported on said first support means and said forming member means is removably supported on said second support means.

33. A tube bender according to claim 29, wherein said forming member means is selectively mountable on said second support means in any one of a plurality of mounting positions radially spaced apart relative to said bend axis.

34. A tube bender according to claim 29, wherein said abutment surf aces are on said first support means and said stop means is on said second support means.

35. A tube bender according to claim 29, wherein said means to angularly displace said second support means about said bend axis includes drive shaft means rotatably mounted on said first support means, and means drivingly interengaging said drive shaft means and said second support means.

36. A tube bender according to claim 35, wherein said drive shaft means is rotatable about an axis parallel to said bend axis.

37. A tube bender according to claim 35, wherein said drive shaft means includes coaxial input and output shaft means and slip clutch means therebetween, said slip clutch means providing said means to preclude relative displacement between said first and second means.

38. A tube bender according to claim 37, wherein said drive shaft means is rotatable about an axis parallel to said bend axis.

39. A tube bender comprising first support means, mandrel means on said first support means and having a bending groove extending about a bend axis, second support means mounted on said first support means for angular displacement relative thereto about said bend axis, forming member means mounted on said second support means for angular displacement therewith about said bend axis and relative to said mandrel means, whereby a tube between said mandrel means and said forming member means is urged into said bending groove during angular displacement of said second support means relative to said first support means, means to angularly displace said second support means relative to said first support means about said bend axis, means providing a plurality of abutment surfaces on one of said first and second support means, said abutment surfaces being angularly spaced apart about said bend axis and each said abutment surface corresponding to a different one of a plurality of bend angles to which a tube can be bent during said angular displacement of said second support means relative to said first support means, and stop means on the other of said first and second support means, said stop means being adjustable to selectively engage any one of said plurality of abutment surfaces to limit said angular displacement of said second support means relative to said first support means during a tube bending operation, said first and second support means having axially spaced apart opposed inner sides, said abutment surfaces being on said inner side of said first support means and extending axially toward said inner side of said second support means, and said stop means including stop member means having inner end means between said opposed inner sides.

40. A tube bender according to claim 39, wherein said inner end means includes a stop element, said stop member means including means supporting said stop element for rotation about a stop member axis parallel to said bend axis, said stop element having peripheral surf ace means eccentric with respect to said stop member axis, and said stop element being rotatable about said stop member axis for selectively positioning said peripheral surface means to engage said abutment surfaces to selectively overbend said tube to any one of a plurality of different overbend angles relative to the bend angle corresponding to each abutment surface.

41. A tube bender according to claim 39, wherein said abutment surfaces are axially stepped relative to one another in the direction toward said inner side of said second support means and said stop member means is axially displaceable relative to said second support means for selectively displacing said inner end means into alignment with any one of said abutment surfaces.

42. A tube bender according to claim 41, wherein said inner end means includes a stop element, said stop member means including means supporting said stop element for rotation about a stop member axis parallel to said bend axis, said stop element having peripheral surface means eccentric with respect to said stop member axis, and said stop element being rotatable about said stop member axis to selectively position said eccentric surface means for engagement with any one of said abutment surfaces to selectively overbend said tube to any one of a plurality of different overbend angles relative to the bend angle corresponding to said one abutment surface.

43. A tube bender according to claim 42, wherein each of said axially stepped abutment surfaces is a planar wall extending radially of said bend axis and said peripheral surface means of said stop element is defined by a plurality of planar surfaces parallel to said stop member axis.

44. A tube bender according to claim 41, wherein said stop member means includes a body portion having an outer end spaced from said inner end means, said second support means including stop member support means supporting said body portion for axial displacement relative to said second support means, and detent means between said body portion and said stop member support means for releasably holding said stop member means in any one of a plurality of different axial positions relative to said second support means, said inner end means in each of said different axial positions being aligned to engage a different one of said axially stepped abutment surfaces.

45. A tube bender according to claim 44, wherein said detent means includes a spring biased detent member on said stop member support means and axially spaced apart recess means in said body portion.

46. A tube bender according to claim 44, wherein each of said stepped abutment surfaces is a planar wall extending radially of said bend axis and said inner end means includes a stop element having peripheral surface means for engaging with said abutment surfaces.

47. A tube bender according to claim 46, wherein said body portion of said stop member means is cylindrical and said stop member support means supports said body portion for rotation about a stop member axis parallel to said bend axis, said peripheral surface means of said stop element being eccentric with respect to said stop member axis, and said body portion being rotatable about said stop member axis in each of said axial positions of said stop member means to selectively position said eccentric surface means to engage the corresponding abutment surface for overbending said tube to any one of a plurality of different overbend angles relative to the bend angle for said corresponding abutment surface.

48. A tube bender according to claim 47, wherein said eccentric peripheral surface means includes a plurality of planar surfaces parallel to said stop member axis.

49. A tube bender according to claim 44, wherein said inner end means includes a stop element on said body portion rotatable therewith about a stop member axis parallel to said bend axis, said stop member support means supporting said body portion and stop element for rotation about said stop member axis, said stop element having peripheral surface means eccentric with respect to said stop member axis, and said stop member being rotatable about said stop member axis to selectively position said eccentric surface means for engagement with any one of said abutment surfaces to selectively overbend said tube to any one of a plurality of different overbend angles relative to the bend angle corresponding to said one abutment surface.

50. A tube bender according to claim 49, wherein said mandrel means is removably supported on said first support means and said forming member means is removably supported on said second support means.

51. A tube bender according to claim 50, wherein said forming member means is selectively mountable on said second support means in any one of a plurality of mounting positions radially spaced apart relative to said bend axis.

52. A tube bender according to claim 49, wherein said means to angularly displace said second support means relative to said first support means includes drive shaft means rotatably mounted on said first support means, and means drivingly interengaging said drive shaft means and said second support means, said shaft means being rotatable about a shaft axis parallel to said bend axis.

53. A tube bender according to claim 52, wherein said drive shaft means includes coaxial input and output shaft means and slip clutch means therebetween.

54. A tube bender according to claim 52, wherein each of said stepped abutment surfaces is a planar wall extending radially of said bend axis, and said eccentric peripheral surface means includes a plurality of planar surfaces parallel to said stop member axis.

55. A tube bender according to claim 54, wherein said detent means includes a spring biased detent member on said stop member support means and axially spaced apart recess means in said body portion.

56. A tube bender according to claim 55, wherein said drive shaft means includes coaxial input and output shaft means and slip clutch means therebetween.

57. A tube bender according to claim 56, wherein said mandrel means is removably supported on said first support means and said forming member means is removably supported on said second support means.

58. A tube bender according to claim 57, wherein said forming member means is selectively mountable on said second support means in any one of a plurality of mounting positions radially spaced apart relative to said bend axis.

* * * * *

UNITED STATES PATENT AND TRADEMARK OFFICE

CERTIFICATE OF CORRECTION

PATENT NO. : 5,284,040

DATED : February 8, 1994

INVENTOR(S) : Valere H.J. Beelen and David L. Machovina

It is certified that error appears in the above-identified patent and that said Letters Patent is hereby corrected as shown below:

Column 13, line 52 change "3" to -- 4 --.

Column 15, line 6 delete "side".

Signed and Sealed this

Sixteenth Day of July, 1996

Bruce Lehman

*Attest:*

BRUCE LEHMAN

*Attesting Officer*

*Commissioner of Patents and Trademarks*